US009347222B2

(12) United States Patent
Bottin

(10) Patent No.: US 9,347,222 B2
(45) Date of Patent: May 24, 2016

(54) WELDED ROOF FOR MODULAR BUILDING UNITS

(71) Applicant: Herve Bottin, La Baule (FR)

(72) Inventor: Herve Bottin, La Baule (FR)

( * ) Notice: Subject to any disclaimer, the term of this patent is extended or adjusted under 35 U.S.C. 154(b) by 0 days.

(21) Appl. No.: 14/801,989

(22) Filed: Jul. 17, 2015

(65) Prior Publication Data

US 2016/0017609 A1 Jan. 21, 2016

Related U.S. Application Data

(60) Provisional application No. 62/026,249, filed on Jul. 18, 2014.

(51) Int. Cl.
*E04B 1/70* (2006.01)
*E04F 17/00* (2006.01)
(Continued)

(52) U.S. Cl.
CPC . *E04D 13/04* (2013.01); *E04B 7/18* (2013.01); *E04D 3/40* (2013.01); *E04D 13/064* (2013.01); *E04H 1/005* (2013.01); *E04H 1/12* (2013.01); *E04H 2001/1283* (2013.01)

(58) Field of Classification Search
CPC ..... E04D 13/04; E04D 13/064; E04D 3/40; E04H 1/005; E04H 1/12; E04H 2001/1283; E04B 7/18; B65D 88/121; B65D 88/124; B62D 25/06; B62D 33/046
USPC ..... 52/302.1; 220/1.5; 296/185.1, 210
See application file for complete search history.

(56) References Cited

U.S. PATENT DOCUMENTS 1,522,200 A * 1/1925 Masury ..... B62D 47/02 296/178
2,421,978 A * 6/1947 Andrews ..... E04D 13/064 52/11

(Continued)

FOREIGN PATENT DOCUMENTS

CN 104018583 9/2014
CN 203878747 U 10/2014

(Continued)

OTHER PUBLICATIONS

ModSpace. "Oil & Natural Gas Buildings" http://www.modspace.com/modular-solutions/modular-buildings/industrialenergy/oil-natura . . . Mar. 3, 2015.

*Primary Examiner* — Joshua J Michener
*Assistant Examiner* — Keith Minter
(74) *Attorney, Agent, or Firm* — Whiteford, Taylor & Preston LLP; Gregory M. Stone

(57) ABSTRACT

Disclosed is a roof assembly for a modular building unit that comprises a roofing sheet that is welded to the frame of the modular building unit to form a unitary, continuous sealed weld between the roofing sheet and the generally horizontal structural frame of the modular building unit, and that is pitched to downwardly direct water toward one end of the modular building unit. The welded roof assembly prevents water infiltration into the modular building unit, and such watertight structure may then receive any gutter configuration the user wishes to implement without risking water infiltration into the building unit. The welded roofing sheet avoids the use of screws or other fasteners, and the associated possibility of water leakage around the screws and into the building unit. The welded roof also is able to employ a single slope all of the way through the full span of the roof, thus avoiding the need for a centrally pitched roof assembly, and its unitary construction avoids the tiling effect that results from the use of multiple, overlapping roofing sheets. The welded roof also avoids the need for silicon or other filler agents between the unitary roofing sheet and the frame of the modular building unit.

22 Claims, 12 Drawing Sheets

(51) Int. Cl.

| | |
|---|---|
| ***E04D 13/04*** | (2006.01) |
| ***E04H 1/00*** | (2006.01) |
| ***E04H 1/12*** | (2006.01) |
| ***E04B 7/18*** | (2006.01) |
| ***E04D 3/40*** | (2006.01) |
| ***E04D 13/064*** | (2006.01) |

(56) References Cited

U.S. PATENT DOCUMENTS 2,787,028 A * 4/1957 Webb ..... A01K 1/033 52/198
3,224,151 A 12/1965 Nystrom
3,971,172 A 7/1976 Gentil
4,100,703 A * 7/1978 Sickler ..... E04D 13/064 52/16
4,545,159 A 10/1985 Rizk
4,637,763 A * 1/1987 Van Iperen ..... B60P 3/073 105/370
4,875,595 A * 10/1989 Van Valkenburg ..... B65D 88/12 206/386
5,004,269 A * 4/1991 Pelt ..... B60P 3/22 280/837
5,011,152 A * 4/1991 Hugunin ..... A63B 69/3694 454/188
5,145,309 A * 9/1992 Foster ..... B65G 25/065 198/750.2
5,193,325 A * 3/1993 Allison ..... E04H 1/1205 52/125.2
5,317,857 A * 6/1994 Allison ..... E04H 1/1205 52/125.6
5,671,855 A * 9/1997 Norman, Jr. ..... B60P 1/6454 220/1.5
5,966,956 A * 10/1999 Morris ..... F25D 11/003 52/69
6,155,747 A * 12/2000 Payne ..... B09B 3/00 405/129.55
6,179,522 B1 * 1/2001 Sanford ..... B09B 3/00 405/129.55
6,279,955 B1 * 8/2001 Fisher ..... B60P 3/221 182/127
6,299,008 B1 * 10/2001 Payne ..... B65D 88/121 220/1.5
6,837,007 B2 1/2005 Floyd et al.
7,827,738 B2 11/2010 Abrams et al.
8,397,441 B2 * 3/2013 Wallance ..... E04B 1/003 52/79.1
8,402,704 B2 * 3/2013 Hartley ..... E04H 6/025 136/244
8,561,367 B2 * 10/2013 Kelly ..... E04D 3/405 52/198
8,642,900 B2 2/2014 Nordling et al.
2006/0037280 A1 * 2/2006 Smith ..... E04D 3/3608 52/747.1
2007/0138173 A1 * 6/2007 Nielsen ..... B65D 88/022 220/4.21
2008/0134589 A1 * 6/2008 Abrams ..... E04B 1/003 52/79.1
2008/0251403 A1 * 10/2008 Nielsen ..... B65D 88/121 206/386
2009/0223143 A1 * 9/2009 Esposito ..... E04B 1/34869 52/79.1
2009/0223153 A1 9/2009 Macgregor
2009/0229194 A1 9/2009 Armillas
2011/0162293 A1 * 7/2011 Levy ..... E04B 1/3483 52/79.9
2011/0260533 A1 * 10/2011 Hardin ..... E04B 1/34336 307/21
2011/0297675 A1 * 12/2011 Johnson ..... B60P 3/14 220/8
2012/0006369 A1 * 1/2012 Cantin ..... E04B 1/34305 135/96
2012/0037198 A1 * 2/2012 Cantin ..... E04B 1/3442 135/143
2012/0077429 A1 * 3/2012 Wernimont ..... F24F 3/161 454/187
2012/0180403 A1 * 7/2012 Kull ..... F21K 9/30 52/79.1
2012/0255241 A1 * 10/2012 Nishikawa ..... E04B 1/34315 52/105
2012/0306236 A1 * 12/2012 Skipper ..... B62D 33/046 296/193.04
2014/0000183 A1 * 1/2014 Perren ..... E04H 1/005 52/79.5
2014/0090312 A1 * 4/2014 Medley ..... E04B 1/34357 52/79.5
2014/0213169 A1 * 7/2014 Rasmussen ..... H05K 7/20745 454/237
2014/0223840 A1 * 8/2014 Wheeler ..... E04B 1/343 52/79.9
2014/0259971 A1 * 9/2014 Bikker ..... A47K 4/00 52/34
2014/0298745 A1 * 10/2014 Rechenmacher ..... E04C 3/02 52/425
2015/0033639 A1 * 2/2015 Wilson ..... E04G 21/00 52/79.5
2015/0075271 A1 * 3/2015 Tracy ..... G01M 17/02 73/146
2015/0101258 A1 * 4/2015 Milo ..... E04H 15/20 52/2.18
2015/0152634 A1 * 6/2015 Unger ..... E04B 1/3483 52/79.2
2015/0159363 A1 * 6/2015 Ehsasi ..... E04H 1/1205 52/79.5
2015/0259938 A1 * 9/2015 Bernard ..... E04H 1/005 52/64

FOREIGN PATENT DOCUMENTS

EP 2674538 A1 12/2013
EP 2674538 B1 12/2014
WO 93/11328 6/1993
WO 93/19262 9/1993
WO WO 9506609 A1 * 3/1995 ..... B65D 88/121
WO 97/44541 11/1997
WO 2008/027234 3/2008
WO 2011/113102 9/2011
WO 2012/068800 5/2012

* cited by examiner

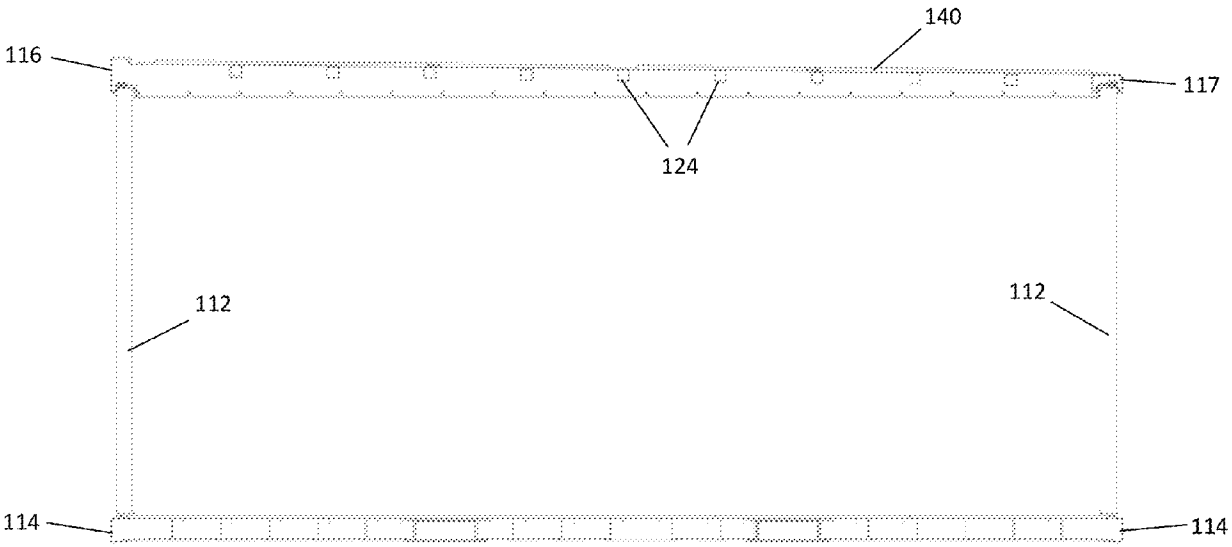
FIGURE 3
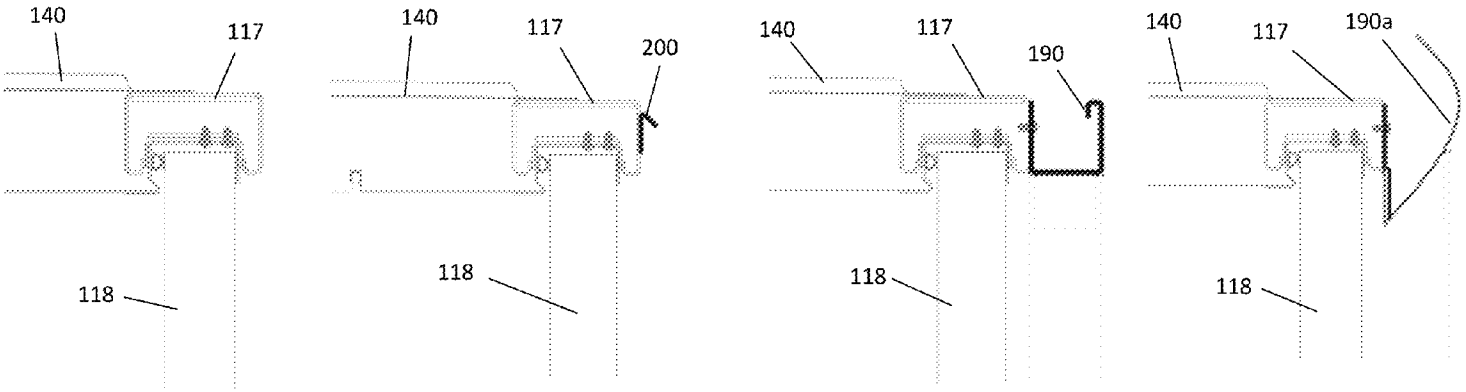
FIGURE 4a
FIGURE 4b
FIGURE 4c
FIGURE 4d

WELDED ROOF FOR MODULAR BUILDING UNITS

CROSS REFERENCE TO RELATED APPLICATION

This application is based upon and claims benefit of U.S. Provisional Patent Application Ser. No. 62/026,249 entitled "WELDED ROOF FOR MODULAR BUILDING UNITS," filed with the U.S. Patent and Trademark Office on Jul. 18, 2014 by the inventor herein, the specification of which is incorporated herein by reference in its entirety.

FIELD OF THE INVENTION

This invention relates generally to modular building construction, and more particularly to a welded roof assembly for a modular building unit configured to receive various gutter system configurations.

BACKGROUND OF THE INVENTION

Roofing members for modular buildings are typically attached by way of screws or other fasteners, and are supplied in sheets arranged in a tile configuration with a portion of one roofing sheet overlapping a portion of an adjacent roofing sheet. In order to channel rainwater and water from snow and ice melt away from the modular building, gutters may be provided along the edges of the modular building unit. However, the type of gutter assembly, and in fact whether a gutter system is required at all, can vary from location to location based upon annual weather patterns, and particularly rain, snow, and ice amounts received in a given area. Different weather patterns may call for different gutter configurations, and at times even no gutter. Moreover, even with water diversion and drainage, conditions may result in water collecting on the roof and leaking into the modular building unit, such as through gaps between adjacent roofing sheets, gaps between the roofing sheets and the frame of the modular building unit, openings around fasteners, and the like. While silicone or other fillers may be provided, they are temporary and subject to failure and leakage over time. While differing gutter configurations may be provided to address different rain, snow, and ice conditions, they will require varied adaptations of the roof structure as well in order to accommodate the varied environmental conditions.

Thus, there remains a need in the art for a roofing configuration for a modular building unit that is able to accept gutters of varied configurations without requiring adaptation or modification of the building unit structure, and that protects against water leakage through the roof in all such gutter configurations, and in the case of no gutter.

SUMMARY OF THE INVENTION

Disclosed is a roof assembly for a modular building unit that comprises a roofing sheet that is welded to the frame of the modular building unit so as to form a unitary, continuous sealed weld between the roofing sheet and the structural frame of the modular building unit, and that is pitched to downwardly direct water on the roofing sheet toward one end of the modular building unit. The welded roof assembly prevents water infiltration into the modular building unit, and such watertight structure may then receive any gutter configuration the user wishes to implement without risking water infiltration into the building unit. Further, the welded roof assembly allows the modular building unit to carry a heavy snow load, as the welds attaching the roofing sheet can easily carry heavy loads. The welded roofing sheet avoids the use of screws, and the associated possibility of water leakage around the screws and into the building unit. The welded roof also permits attachment, e.g. via welding, of safety rings or other accessories directly on the roof sheet without need for specialized holes or other configurations or specific location requirements. The welded roof also is able to employ a single slope all of the way through the full span of the roof, thus avoiding the need for a centrally pitched roof assembly, and its unitary construction avoids the tiling effect that results from the use of multiple, overlapping roofing sheets. The welded roof also avoids the need for silicon or other filler agents between the unitary roofing sheet and the frame of the modular building unit. Still further, the recessed roofing panel within the exterior frame formed by the upper rails of the building unit, along with the horizontal top surfaces of such rails, provided for easy vertical stacking of modular building units atop one another.

In accordance with certain aspects of an embodiment of the invention, a roof assembly is provided for a modular building unit, comprising: a first long rail having a top wall, an exterior wall, and an interior wall; a second long rail parallel to the first long rail and having a top wall, an exterior wall, and an interior wall; a first short rail extending between the first and second long rails and having a top wall, an exterior wall, and an interior wall; a second short rail extending between the first and second long rails and having a top wall and an exterior wall, wherein the first and second long rails and the first and second short rails are joined to form a rectangular exterior roof frame of a modular building unit; and a roofing sheet, wherein the roofing sheet is joined to the first short rail at a first elevation below the top wall of the first short rail, the roofing sheet is joined to each of the first and second long rails at a point below the top wall of each of the first and second long rails and extending in a downward slope from the first elevation, and the roofing sheet is joined to the top surface of the second short rail at a lowest elevation of the roofing sheet; and wherein the roofing sheet is joined to the first short rail, each of the first and second long rails, and the top surface of the second short rail by a continuous weld.

In accordance with further aspects of an embodiment of the invention, a method of forming a roof assembly for a modular building unit is provided, comprising the steps of: providing a roof frame comprising a first long rail having a top wall, an exterior wall, and an interior wall; a second long rail parallel to the first long rail and having a top wall, an exterior wall, and an interior wall; a first short rail extending between the first and second long rails and having a top wall, an exterior wall, and an interior wall; and a second short rail extending between the first and second long rails and having a top wall and an exterior wall, wherein the first and second long rails and the first and second short rails are joined to form a rectangular exterior roof frame of a modular building unit; joining a roofing sheet to the first short rail at a first elevation below the top wall of the first short rail; joining the roofing sheet to each of the first and second long rails at a point below the top wall of each of the first and second long rails and extending in a downward slope from the first elevation; and joining the roofing sheet to the top surface of the second short rail at a lowest elevation of the roofing sheet; wherein the steps of joining the roofing sheet to the first short rail, each of the first and second long rails, and the top surface of the second short rail is performed by making a continuous weld.

BRIEF DESCRIPTION OF THE DRAWINGS

The numerous advantages of the present invention may be better understood by those skilled in the art by reference to the accompanying drawings in which:

FIG. 3 is a cross-sectional view of the skeletal frame of FIG. 2.

FIGS. 4*a* through 4*d* are close-up, cross-sectional views of the lower roof edge of the frame of FIG. 3 with varying gutter configurations.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
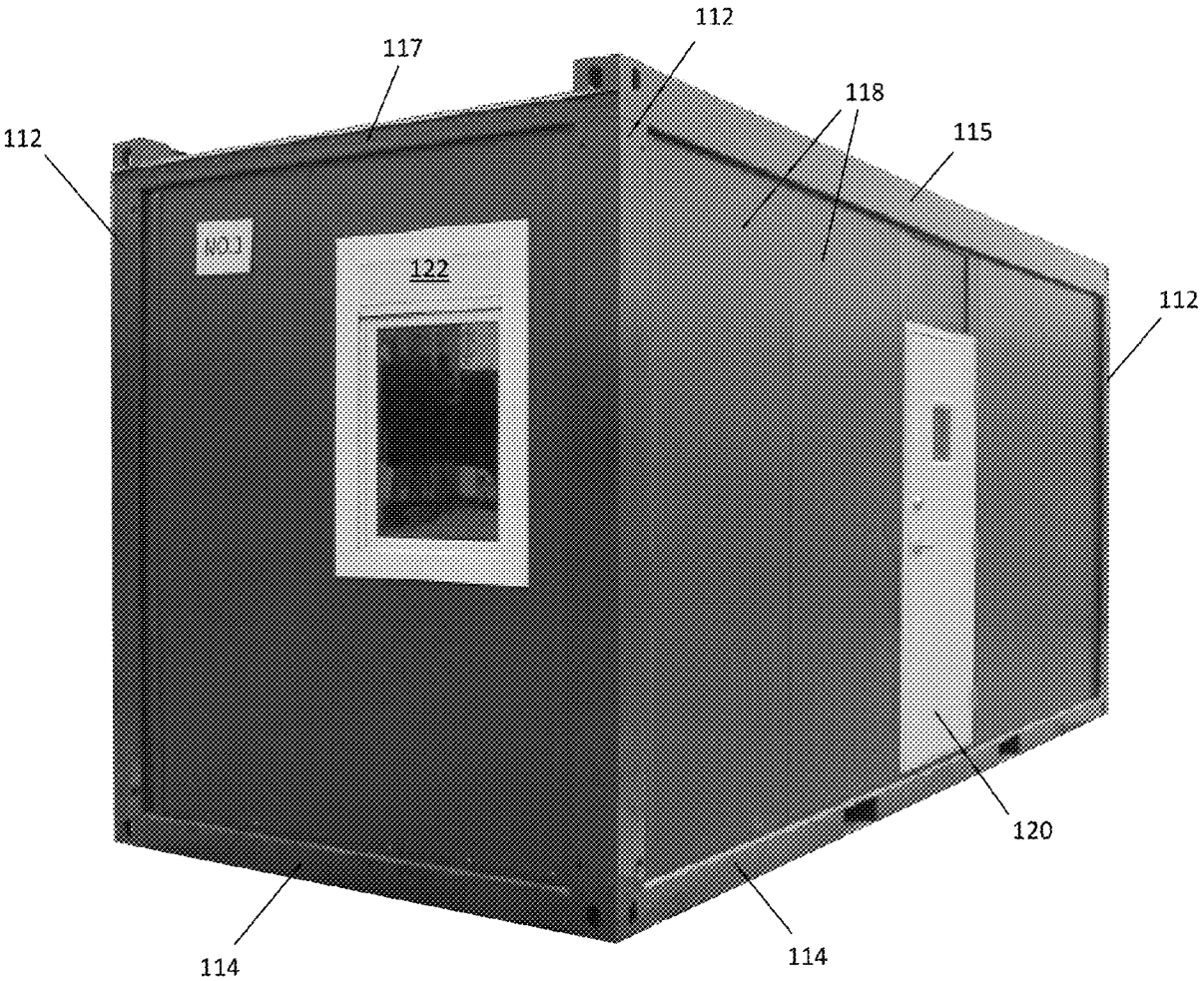
FIG. 1 is a perspective view of a modular building unit in accordance with certain aspects of an embodiment of the invention.

FIG. 1 provides a perspective view of a modular building unit 100 in accordance with certain aspects of an embodiment of the invention. Modular building unit 100 includes a skeletal frame formed by corner support posts 112, bottom rails 114, top long rails 115, a first top short rail 116 (shown in FIG. 2), and a second top short rail 117. This skeletal frame provides the key structural integrity for the modular building unit. Positioned between corner support posts 112, bottom rails 114, and top rails 115, 116 and 117 are wall panels 118 that form the wall structures spanning each side of the modular building unit. Other standard building features, such as doors 120 and windows 122, may be provided and integrated with individual wall panels 118.

Figure 2:
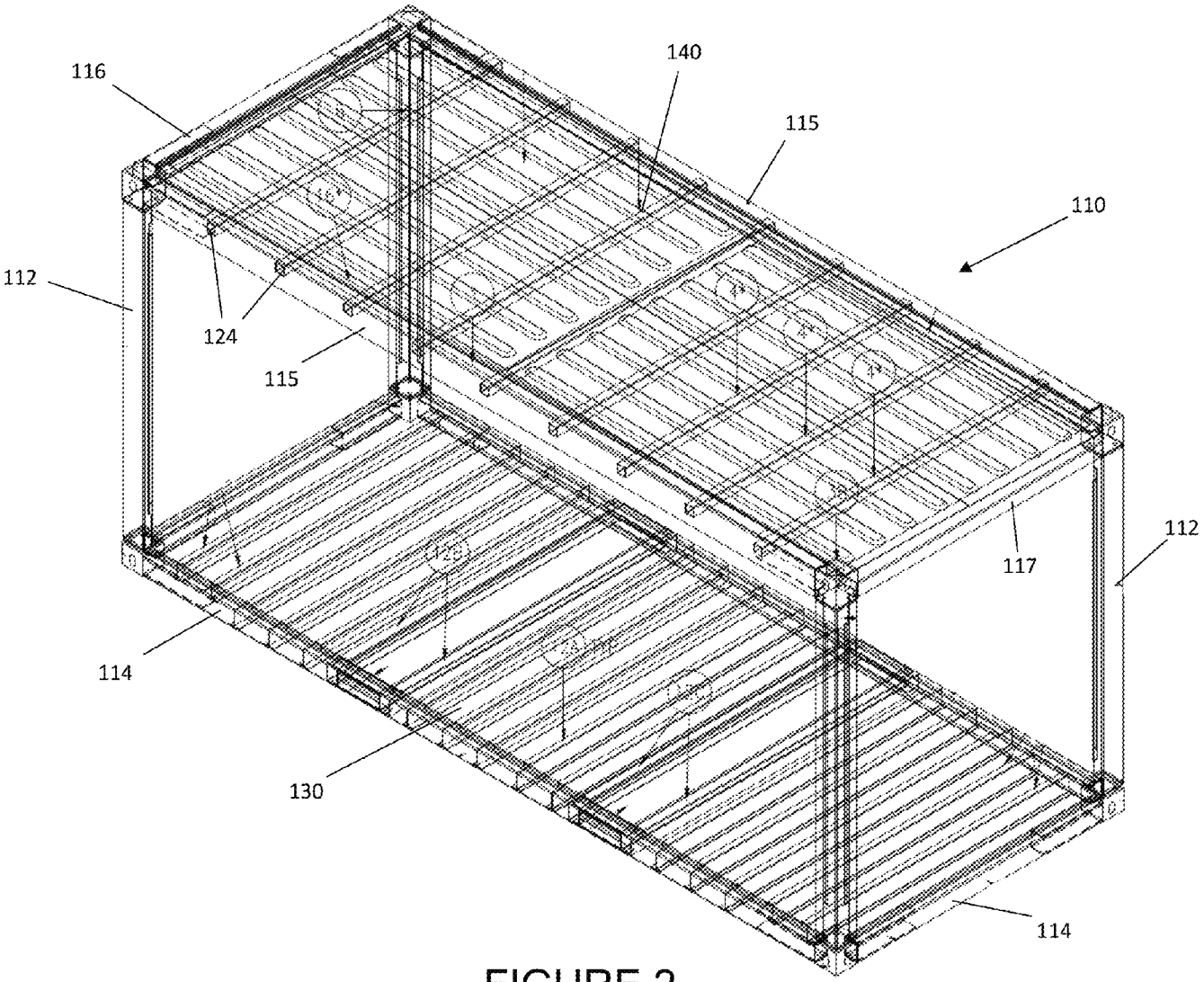
FIG. 2 is a perspective view of a skeletal frame of the modular building unit of FIG. 1.

FIG. 2 is a perspective view of the skeletal frame forming the modular building unit of FIG. 1. As shown in FIG. 2, the skeletal frame comprises four corner posts 112 extending upward from bottom rails 114 and supporting the roof portion of the modular building unit 100. The roof portion includes top long rails 115 extending lengthwise between adjacent corner support posts 112, a first top short rail 116 extending between adjacent corner supports posts 112 and generally perpendicular to top long rails 115, and a second top short rail 117 extending between adjacent corner support posts 112 and generally perpendicular to top long rails 115. A roofing sheet 140 forms the exterior roof of the modular building unit, and sits within the interior of the frame defined by top long rails 115, first top short rail 116, and second top short rail 117. Roofing sheet 140 may have a thickness of preferably 1 to 3 mm, and more preferably 2 mm, and may either comprise a flat sheet or a corrugated sheet comprised of continuous or segmented ribs as shown in FIG. 2. If corrugated (which may be desirable depending upon typical roof rain and snow loads in the locale where the modular building unit is to be installed), ribs from the corrugated sheet may help with drainage of water. The roofing sheet 140 is welded around its entire perimeter to top long rails 115, first top short rail 116, and second top short rail 117, all as discussed in greater detail below, to ensure complete water tightness, particularly in the case of snow and ice. Roofing sheet 140 is also welded, such as by spot welding, to purlins 124 spanning the width of the roof portion and extending between parallel top long rails 115, again as discussed in greater detail below.

Moreover, and as better shown in the cross-sectional view of the skeletal frame of FIG. 3, roofing sheet 140 slopes downward from first top short rail 116 to second top short rail 117 so as to direct all water to the lowest elevation of the roof portion of the modular building unit. In order to provide such downward slope, purlins 124 are positioned at progressively lower elevations, with each end of each purlin being rigidly affixed (e.g., welded) to an interior face of each top long rail 115. Such configuration results in roofing sheet 140 realizing a downward slope of preferably between 0.5% and 5% from one end of the module to the other. In certain configurations, roofing sheet 140 may have two, opposite sloping sections (not shown), each having a downward slope of 0.5% to 5% from the middle of the modular building unit to the end of the modular building unit.

Because the modular building unit is configured with a fully welded roof, the modular building unit may be configured with varied gutter options, including no gutter. Those varying gutter options are shown in the exemplary configurations reflected in FIGS. 4*a* through 4*d*. FIG. 4*a* shows the lowest roof edge of modular building unit 100, including roofing sheet 140 welded directly to the top face of second top short rail 117, which in turn is mounted above wall panel 118. In this configuration, no gutter is provided, in which case water from the room will directly flow off of the roof, while the weld around the perimeter of roofing sheet 140 prevents infiltration of water into the modular building unit. Next, FIG. 4*b* shows the same roof edge of modular building unit 100, with a water deflector 200 attached to the exterior face of second top short rail 117, which deflector 200 may aid in directing water flowing from the roof away from the side wall panels 118 of modular building unit 100. Likewise, FIG. 4*c* shows the same roof edge of modular building unit 100, with gutter 190 attached to the exterior face of second top short rail 117, which gutter 190 may receive water flowing from the roof and direct such water to a downspout (not shown) as discussed further below. Similarly, FIG. 4*d* shows the same roof edge of modular building unit 100, with an alternative gutter 119*a* attached to the exterior face of second top short rail 117, which alternative gutter 119*a* is attached in the same manner as gutter 119 but embodies a decorative design to improve the overall aesthetic appearance of the modular building unit 100. Those of ordinary skill in the art will recognize that gutter assemblies of other varying configurations may likewise be provided without departing from the spirit and scope of the invention.

Figure 5:
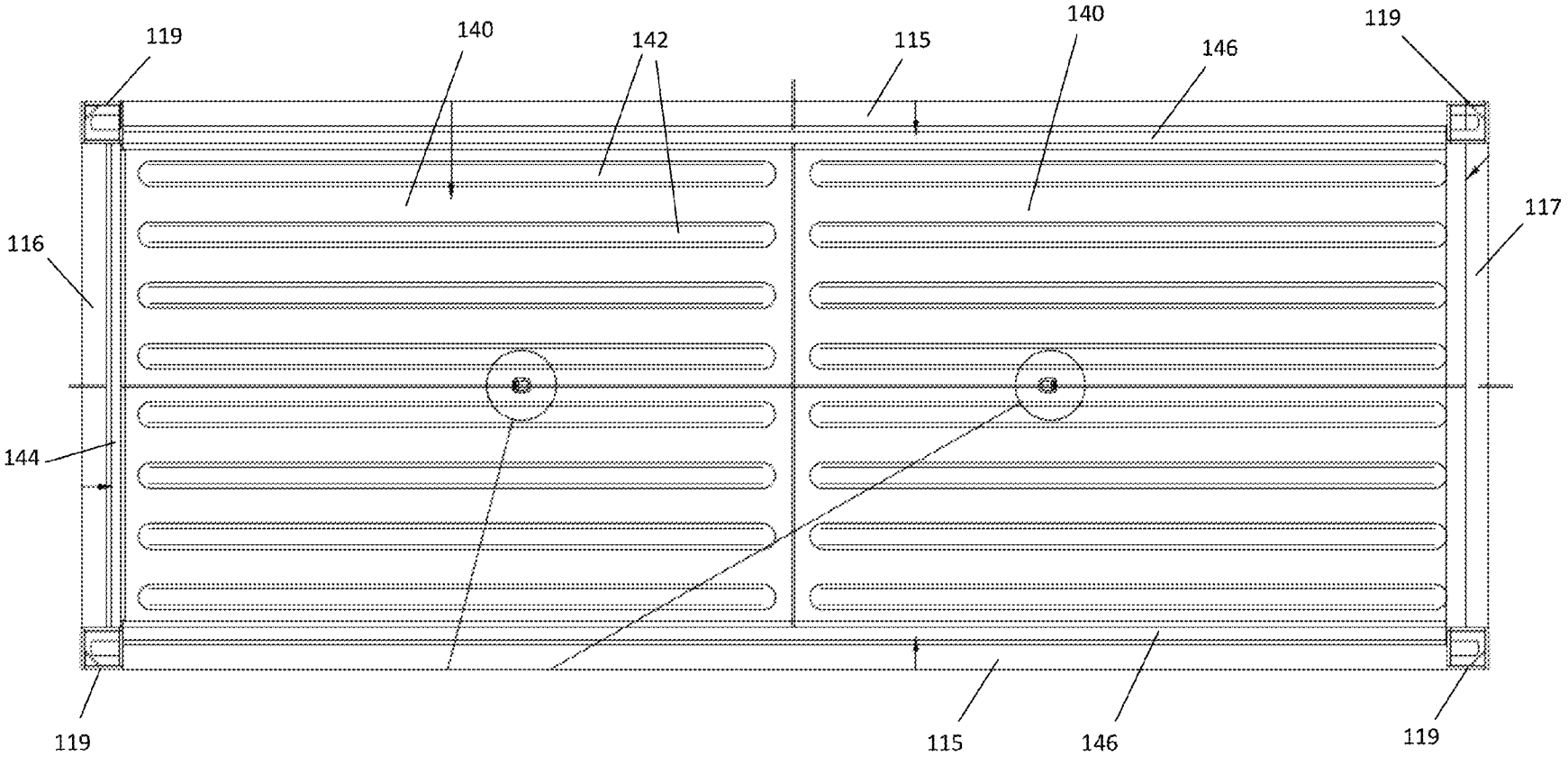
FIG. 5 is a top view of a roof portion of the modular building unit of FIG. 1.
Figure 6:
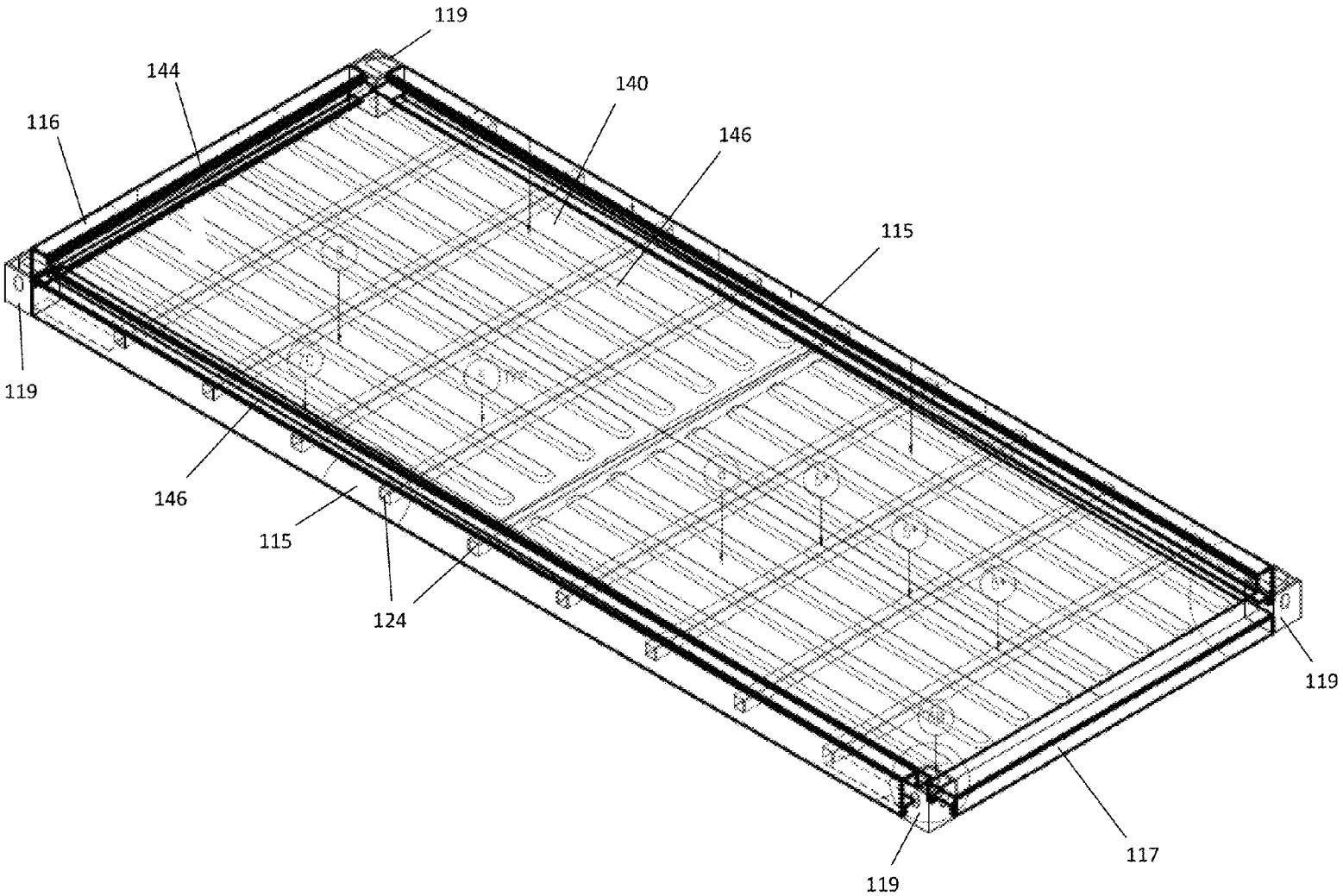
FIG. 6 is a perspective view of the roof portion of FIG. 5.

FIG. 5 provides a top view, and FIG. 6 provides a perspective view, of the roof portion of modular building unit 100. Roofing sheets 140 are shown spanning the full length of the roof, and as mentioned above, may optionally include ribs 142 that may aid in directing water toward the lowest elevation point on the roof (i.e., toward second top short rail 117). Optionally, roofing sheets 140 may be provided in separate sections, in which each of the sections are preferably welded together to form the same waterproof, welded seam that is provided along the perimeter of roofing sheet 140. Mounting brackets are provided at the interior faces of each of first top short rail 116 and the two top long rails 115. More specifically, roofing sheet short side mounting bracket 144 is affixed to and runs parallel to first top short rail 116, and roofing sheet long side brackets 146 are affixed to and run parallel to each top long rail 115. Roofing sheet short side mounting bracket 144 provides a horizontal mounting and welding surface for the highest elevation portion of roofing sheet 140, while roofing sheet long side brackets 146 provide a downwardly angled mounting and welding surface for the long edges of roofing sheet 140, resulting in the roofing sheet 140 following a downward slope from first top short rail 116 to second top short rail 117. The lowest elevation point of roofing sheet 140 is welded directly to the top surface of second top short rail 117, again allowing water on roofing sheet 140 to flow directly onto and over second top short rail 117.

Corner boxes 119 may be provided at each corner of the roof portion of modular building unit 100, which corner boxes 119 principally serve as corner elements for joining each perpendicular pair of rails and one of corner support posts 112. Corner boxes 119 may also be provided features, such as openings, in the top and side walls of each corner box 119 to receive a crane hook or other device to aid in lifting the entire modular building unit when necessary for transport or installation.

Figure 7:
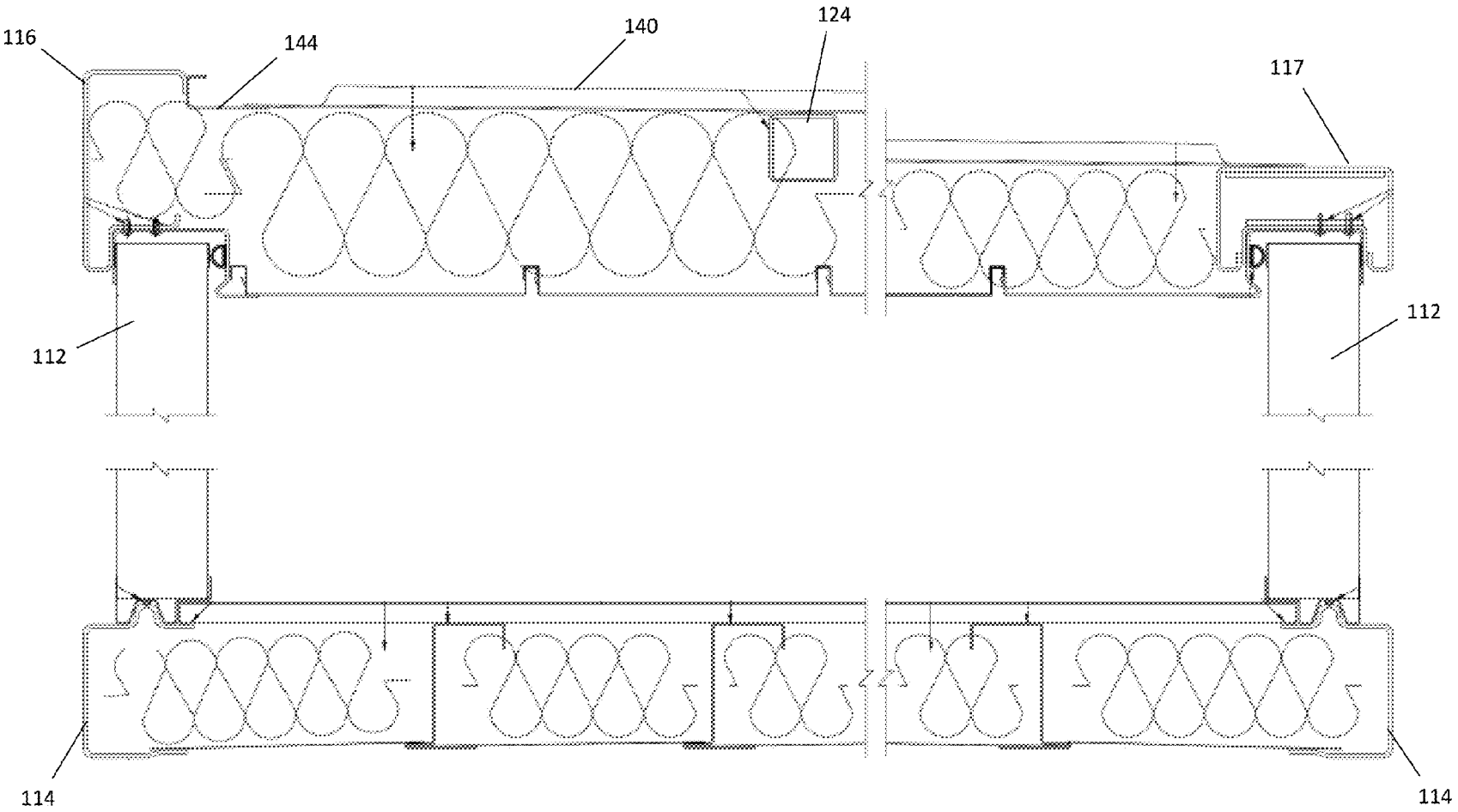
FIG. 7 is a close-up, detail cross-sectional view of the frame of FIG. 3.

FIG. 7 provides a close-up, detailed cross-sectional view of the skeletal frame of modular building unit 100. First top short rail 116 is shown at the left most portion of FIG. 7, with roofing sheet short side mounting bracket 144 extending from the interior face of first top short rail 116 and supporting roofing sheet 140. The underside of roofing sheet 140 overlaps a portion of roofing sheet short side mounting bracket 144 and is welded to short side mounting bracket 144. Likewise, as roofing sheet 140 extends toward second top short rail 117, it rests on and is preferably welded to purlins 124. At the opposite end from first top short rail 116 (i.e., the right edge as viewed in FIG. 7), roofing sheet 140 overlaps a portion of second top short rail 117 and is welded to the top of second top short rail 117.

Other features, including sealed joints attaching the overall roof portion to wall panels 112, interior ceiling trays, and subfloor construction details, are shown in FIG. 7 but are not critical to the roofing structure of the instant invention, and thus are not described further here.

Figure 9:
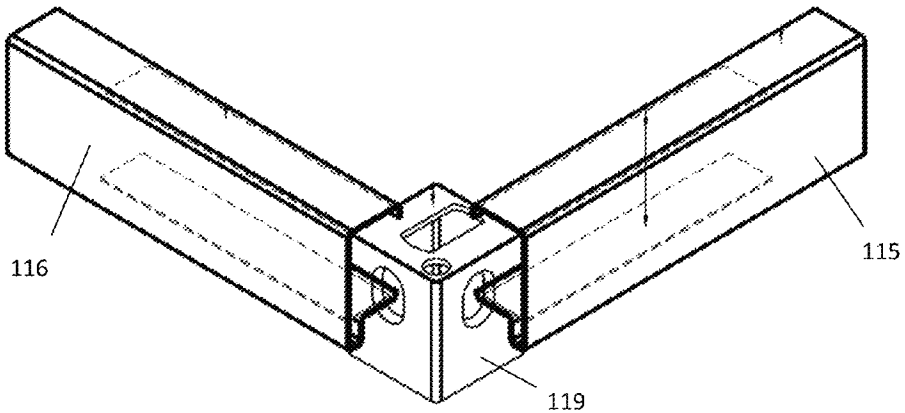
FIG. 9 is a perspective view showing connection of the first top short rail and one of the top long rails of the frame of FIG. 7.
Figure 8:
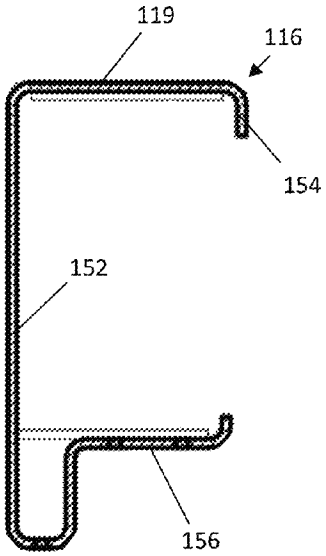
FIG. 8 is a cross-sectional view of a first, higher elevation top short rail of the frame of FIG. 7.

FIG. 8 is a cross-sectional view of first top short rail 116, and FIG. 9 is a perspective view of first top short rail 116 connecting to one of top long rails 115 through a connecting corner box 119. As shown in FIGS. 8 and 9, first top short rail 116 has a planar top face 150, a planar outer face 152 that forms a portion of the exterior side wall of modular building unit 100, interior bracket flange 154, and bottom profile 156 to fit with a modular wall panel as shown in FIG. 7. Interior bracket flange 154 extends downward from the interior edge of planar top face 150, and provides an attachment surface for roofing sheet short side mounting bracket 144.

Figure 11:
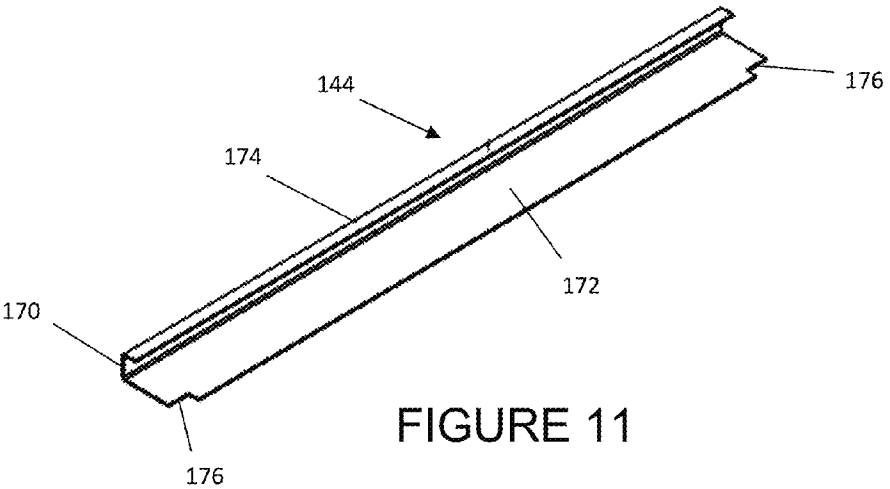
FIG. 11 is a perspective view of the roofing sheet short side mounting bracket of FIG. 10.
Figure 10:
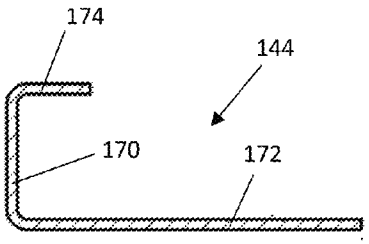
FIG. 10 is a cross-sectional view of a roofing sheet short side mounting bracket of the frame of FIG. 7.

FIG. 10 provides a cross-sectional view of roofing sheet short side mounting bracket 144, and FIG. 11 provides a perspective view of such roofing sheet short side mounting bracket 144. Bracket 144 comprises a back wall 170 configured for attachment, such as by welding, to interior bracket flange 154 of first top short rail 116. Bracket 144 also has a short side roofing sheet support surface 172 which, when bracket 144 is mounted on first top short rail 116, extends generally horizontally and parallel to planar top face 150 of first top short rail 116. Support surface 172 supports the highest elevation end of roofing sheet 140, with the underside of roofing sheet 140 resting on the top side of support surface 172 and the two being joined by a continuous weld. Bracket 144 may also include a top lip 174 extending generally parallel to short side roofing sheet support surface 172, which top lip 174 limits the opportunity for wind to blow water onto top short rail 116, so that water remains contained on roof sheet 140. Further, corner notches 176 are provided at opposite ends of support surface 172 to allow contact with edges of roofing sheet long side brackets 146, in order to provide a continuous surface to receive a continuous weld around the entire perimeter of roofing sheet 140.

Figure 12:
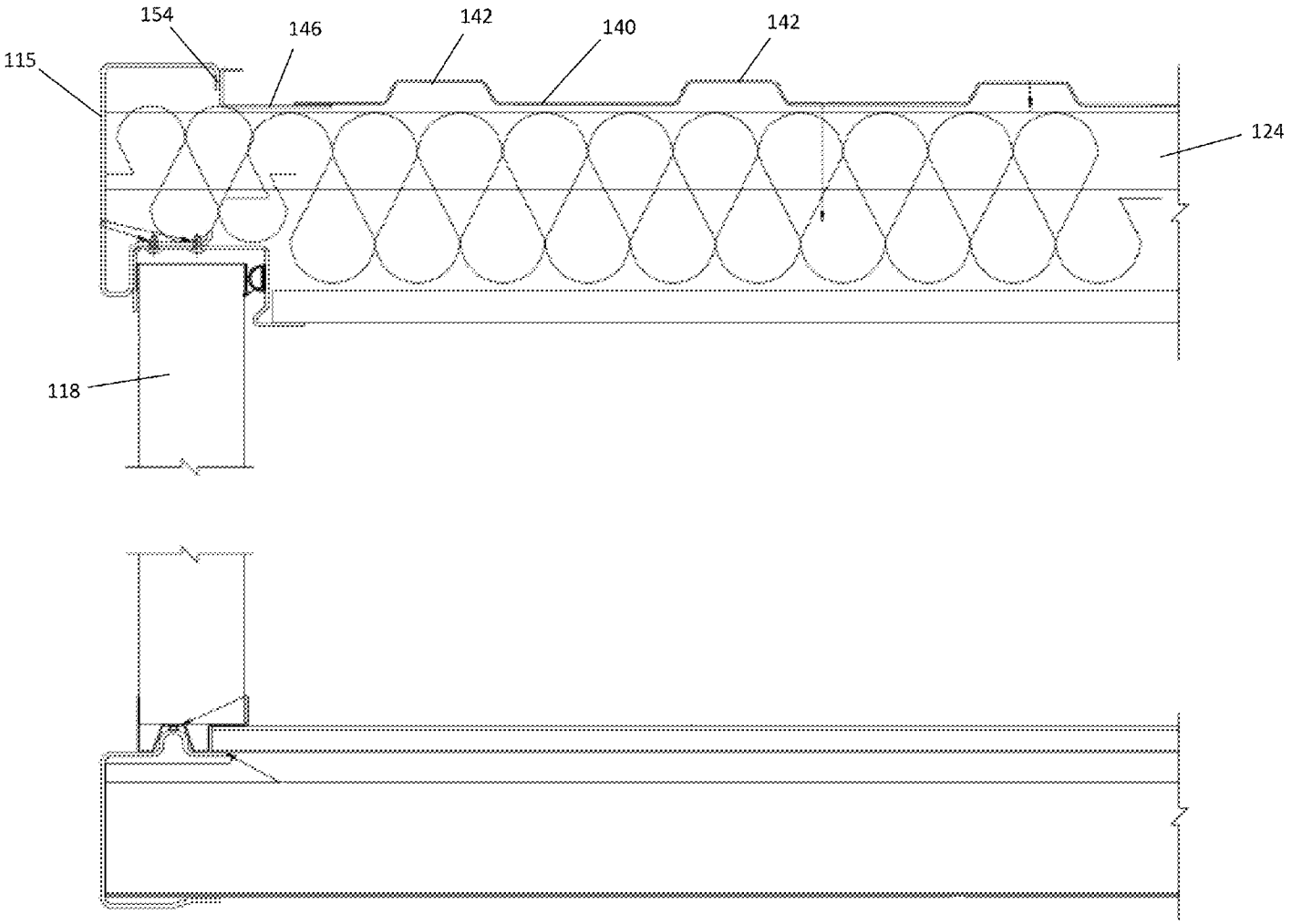
FIG. 12 is a close-up, detail cross-sectional view of the frame of FIG. 3 along an axis parallel to the first top short rail (showing the long rails in cross-section).

Next, FIG. 12 provides a cross-sectional view of the skeletal frame of modular building unit 100 along an axis parallel to first top short rail 116 (showing the top long rails 115 in cross section). Top long rails 115 are of generally the same cross-sectional configuration as first top short rail 116 (although obviously with a longer overall length dimension). Roofing sheet long side mounting brackets 146 are affixed (e.g., welded) to interior bracket flange 154 of long rails 115 and support roofing sheet 140 along its long edge. The underside of the long edge of roofing sheet 140 overlaps a portion of roofing sheet long side mounting brackets 146 and is welded to long side mounting brackets 146. Likewise and as mentioned above, roofing sheet 140 is supported by and is preferably welded to purlins 124 for additional support.

Figure 15:
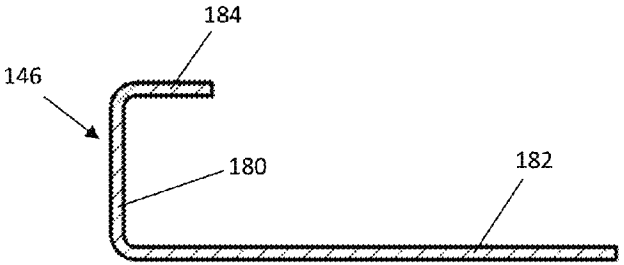
FIG. 15 is a cross-sectional view of the roofing sheet long side bracket of FIG. 14 along section line A-A.
Figure 16:
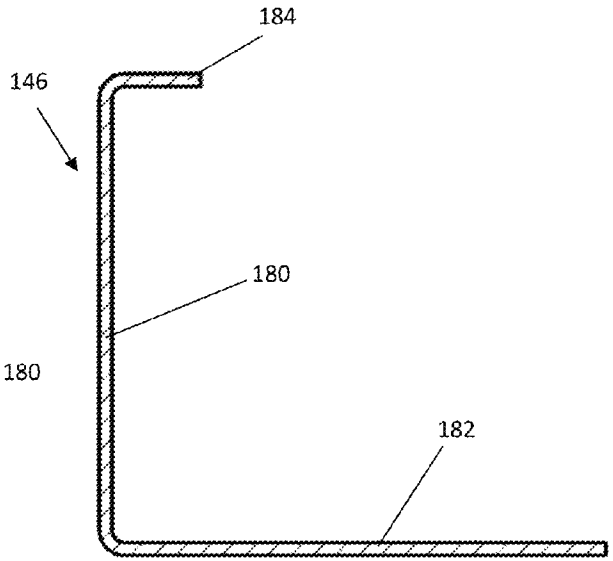
FIG. 16 is a cross-sectional view of the roofing sheet long side bracket of FIG. 14 along section line B-B.
Figure 13:
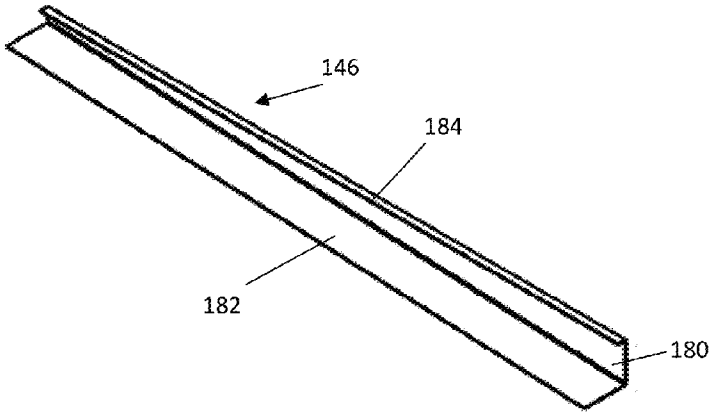
FIG. 13 is a perspective view of a roofing sheet long side bracket 146 for a first long side of the frame of FIG. 7.
Figure 14:
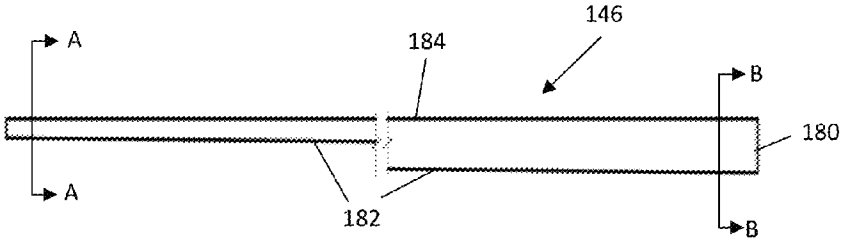
FIG. 14 is a rear view of the roofing sheet long side bracket of FIG. 15.

FIG. 13 is a perspective view of a roofing sheet long side bracket 146 for attachment to a first one of top long rails 115. Those of ordinary skill in the art will appreciate that the opposite top long rail 115 will receive a similarly configured long side bracket 146 that is the mirror image of the bracket shown in FIG. 13. Likewise, FIG. 14 is a rear view of roofing sheet long side bracket 146. Further, FIG. 15 provides a cross-sectional view of bracket 146 along section line A-A of FIG. 14, and FIG. 16 provides a cross-sectional view of bracket 146 along section line B-B of FIG. 14. As shown in FIGS. 13 through 16, bracket 146 includes a back wall 180 providing an attachment surface for attaching (e.g., welding) bracket 146 to interior bracket flange 154 of top long rails 115. Back wall 180 has a generally horizontal top edge and a downwardly sloping bottom edge. Likewise, bracket 146 has a long side roofing sheet support surface 182 which, when each bracket 146 is mounted on its respective top long rail 115, extends outward from back wall 180 and provides a downwardly sloping support surface for the long edge of roofing sheet 140, with the underside of such long edge of roofing sheet 140 resting on the top side of support surface 182 and the two being joined by a continuous weld. Such continuous weld seamlessly extends from the weld joining the highest elevation portion of roofing sheet 140 to short side roofing sheet support surface 172. Bracket 146 may also include a top lip 184 extending generally parallel to top long rails 115, again serving to keep water from being blown off of roofing sheet 140.

Figure 18:
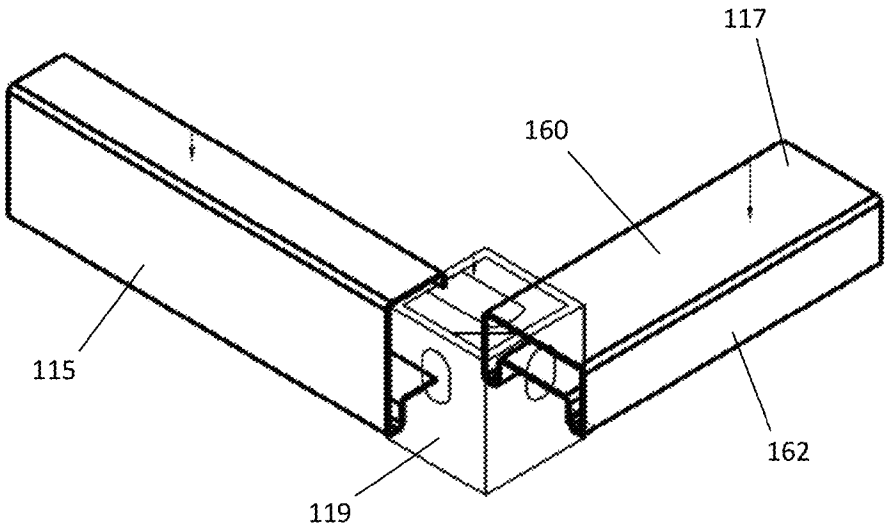
FIG. 18 is a perspective view showing connection of the second top short rail and one of the top long rails of the frame of FIG. 17.
Figure 17:
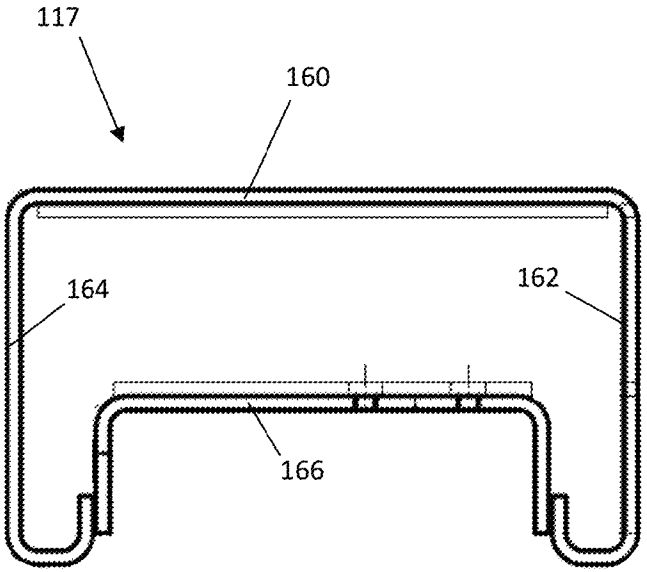
FIG. 17 is a cross-sectional view of a second, lower elevation top short rail of the frame of FIG. 7.

FIG. 17 shows a cross-sectional view of second top short rail 117, and FIG. 18 is a perspective view of second top short rail 117 connecting to one of top long rails 115 through a connecting corner box 119. As shown in FIGS. 17 and 18, second top short rail 117 has a planar top face 160 configured to directly receive an overlapping portion of the lowest elevation section of roofing sheet 140. As noted above, roofing sheet 140 is welded directly to such planar top face 160 of second top short rail 117, and such weld seamlessly continues from the weld attaching roofing sheet 140 to each of roofing sheet short side mounting bracket 144 and roofing sheet long side brackets 146. Second top short rail 117 also has a planar outer face 162 which is configured to directly receive various gutter configurations as discussed in greater detail below, or alternatively to form a portion of the exterior side wall of modular building unit 100 (in cases where no gutter system is to be used). Second top short rail 117 further includes planar interior face 164 and a bottom profile 166 to fit with a modular wall panel as shown in FIG. 7.

Figure 19:
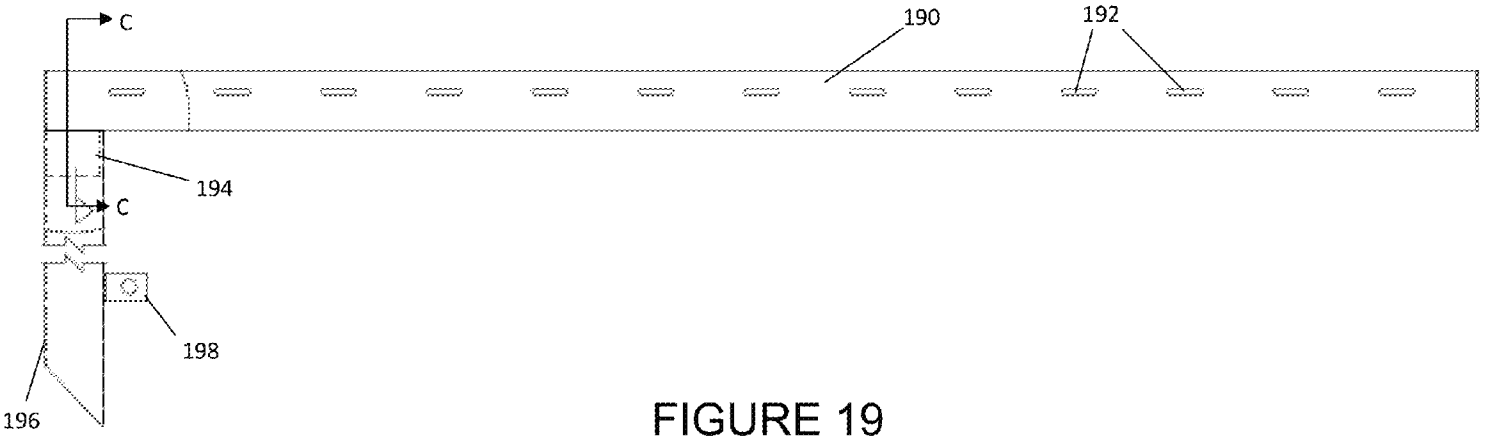
FIG. 19 shows an external gutter and drain pipe for use with the roof portion of FIG. 6.
Figure 20:
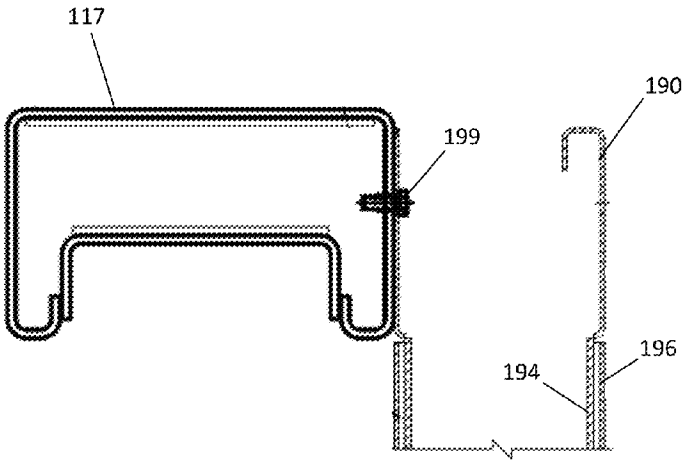
FIG. 20 is a cross-sectional view of the gutter and drain pipe of FIG. 19 attached to second top short rail of the frame of FIG. 7.

FIG. 19 shows an external gutter 190 for use with the welded roof described above. External gutter 190 may include a plurality of overflow openings 192 provided on the outermost wall of gutter 190, and a spigot 194 at one end of gutter 190. Spigot 194 is shaped to fit within a drain pipe 196, which drain pipe may be joined to modular building unit 100 with, by way of non-limiting example, an angle bracket 198, such as to one of corner support posts 112 that is adjacent to second top short rail 117. Likewise, FIG. 20 shows a cross-sectional view along section line C-C of FIG. 19 of the gutter 190 and drain pipe 196, with external gutter 190 attached to second top short rail 117 with one or more fasteners 199, such as a screw.

Figure 21:
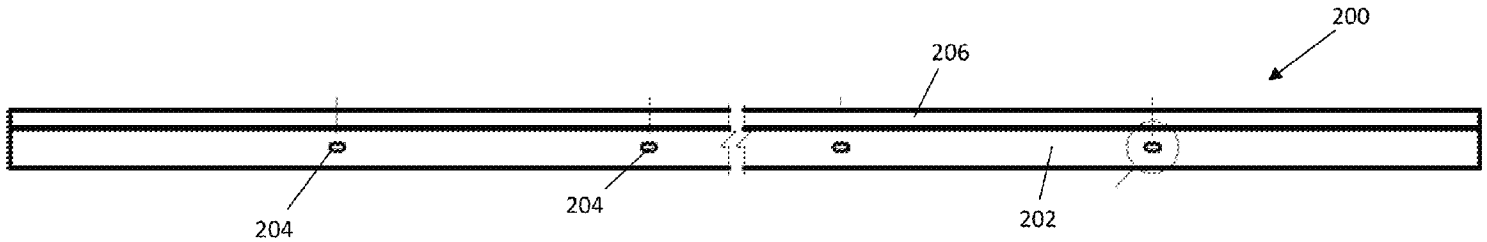
FIG. 21 shows an external water deflector for use with the roof portion of FIG. 6.
Figure 22:
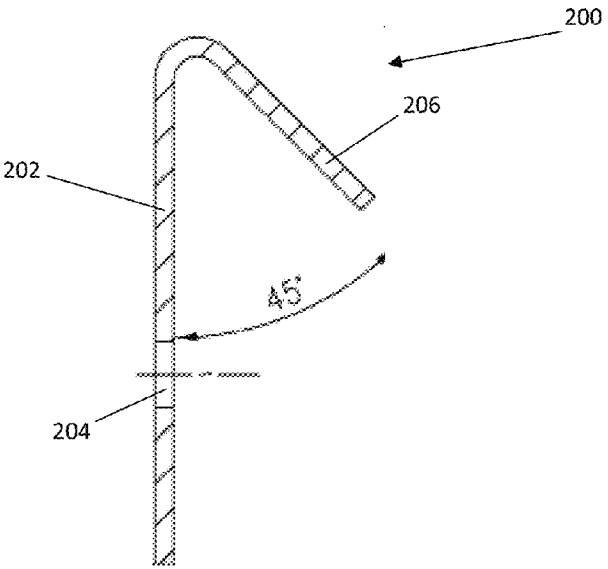
FIG. 22 is a cross-sectional view of the water deflector of FIG. 21.

Similarly, FIG. 21 shows an external water deflector 200 for use with the welded roof described above, and FIG. 22 provides a cross-sectional view of such water deflector 200. With reference to both FIGS. 21 and 22, water deflector 200 has a back wall 202 that is configured for facing attachment to planar outer face 162 of second top short rail 117, a plurality of openings 204 for receiving connectors (e.g., screws) for such attachment, and an upper angle 206 configured to direct water outward and away from the edge of the roof of modular building unit 100 as it flows off of the roof.

The foregoing configuration results in a modular building unit having a roof structure that may readily receive a variety of gutter configurations, and that is simultaneously effective with no gutter, in an assembly that protects against water infiltration into the modular building unit regardless of the gutter configuration. Thus, a single modular building unit configuration may be provided in geographies having widely varied rain and snow conditions, with gutters being added (or not) depending upon the specific precipitation conditions of that particular environment, saving the user from having to maintain multiple configurations for differing environements.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A roof assembly for a modular building unit, comprising:

a first long rail having a top wall, an exterior wall, and an interior wall;

a second long rail parallel to said first long rail and having a top wall, an exterior wall, and an interior wall;

a first short rail extending between said first and second long rails and having a top wall, an exterior wall, and an interior wall;

a second short rail extending between said first and second long rails and having a top wall and an exterior wall, wherein said first and second long rails and said first and second short rails are joined to form a rectangular exterior roof frame of a modular building unit; and a roofing sheet;

wherein said roofing sheet is joined to said first short rail at a first elevation below said top wall of said first short rail, said roofing sheet is joined to each of said first and second long rails at a point below said top wall of each of said first and second long rails and extending in a downward slope from said first elevation, and said roofing sheet is joined to said top wall of said second short rail at a lowest elevation of said roofing sheet; and wherein said roofing sheet is joined to said first short rail, each of said first and second long rails, and said top wall of said second short rail by a continuous weld.

2. The roof assembly of claim 1, wherein said exterior wall of said second short rail further comprises a planar outer face forming a portion of an exterior facing wall of a modular building unit.

3. The roof assembly of claim 2, further comprising a gutter removably attached to said planar outer face of said second short rail.

4. The roof assembly of claim 2, further comprising a downwardly and outwardly angled water deflector removably attached to said planar outer face of said second short rail.

5. The roof assembly of claim 1, said first short rail further comprising a mounting bracket having a horizontal support surface, and wherein said roofing sheet is welded to said horizontal support surface at said first elevation.

6. The roof assembly of claim 1, said roofing sheet having two long edges extending parallel to said first and second long rails and two short edges extending parallel to said first and second short rails, wherein each of said first and second long rails further comprise a mounting bracket having a downwardly angled support surface, and wherein said long edges of said roofing sheet are welded to each of said downwardly angled support surfaces.

7. The roof assembly of claim 1, further comprising a plurality of purlins extending between said first and second long rails.

8. The roof assembly of claim 7, wherein said purlins are positioned at progressively lower elevations along a length of each of said first and second long rails.

9. The roof assembly of claim 8, wherein said roofing sheet is welded to said plurality of purlins.

10. The roof assembly of claim 1, said roofing sheet further comprising a plurality of ribs extending along a longest length dimension of said roofing sheet.

11. The roof assembly of claim 10, wherein said ribs are configured to direct water to said top surface of said second short rail.

12. A method of forming a roof assembly for a modular building unit, comprising the steps of:

providing a roof frame comprising:

a first long rail having a top wall, an exterior wall, and an interior wall;

a second long rail parallel to said first long rail and having a top wall, an exterior wall, and an interior wall;

a first short rail extending between said first and second long rails and having a top wall, an exterior wall, and an interior wall; and a second short rail extending between said first and second long rails and having a top wall and an exterior wall, wherein said first and second long rails and said first and second short rails are joined to form a rectangular exterior roof frame of a modular building unit;

joining a roofing sheet to said first short rail at a first elevation below said top wall of said first short rail;

joining said roofing sheet to each of said first and second long rails at a point below said top wall of each of said first and second long rails and extending in a downward slope from said first elevation; and joining said roofing sheet to said top wall of said second short rail at a lowest elevation of said roofing sheet;

wherein said steps of joining said roofing sheet to said first short rail, each of said first and second long rails, and said top wall of said second short rail is performed by making a continuous weld.

13. The method of claim 12, wherein said exterior wall of said second short rail further comprises a planar outer face forming a portion of an exterior facing wall of a modular building unit.

14. The method of claim 13, further comprising the step of removably attaching a gutter to said planar outer face of said second short rail.

15. The method of claim 13, further comprising the step of removably attaching a downwardly and outwardly angled water deflector to said planar outer face of said second short rail.

16. The method of claim 12, said first short rail further comprising a mounting bracket having a horizontal support surface, and wherein said step of joining said roofing sheet to said first short rail further comprising welding said roofing sheet to said horizontal support surface at said first elevation.

17. The method of claim 12, said roofing sheet having two long edges extending parallel to said first and second long rails and two short edges extending parallel to said first and second short rails, wherein each of said first and second long rails further comprise a mounting bracket having a downwardly angled support surface, and wherein said step of joining said roofing sheet to each of said first and second long rails further comprises welding said long edges of said roofing sheet to each of said downwardly angled support surfaces.

18. The method of claim 12, wherein said roof frame further comprising a plurality of purlins extending between said first and second long rails.

19. The method of claim 18, wherein said purlins are positioned at progressively lower elevations along a length of each of said first and second long rails.

20. The method of claim 19, further comprising the step of welding said roofing sheet to said plurality of purlins.

21. The method of claim 12, said roofing sheet further comprising a plurality of ribs extending along a longest length dimension of said roofing sheet.

22. The method of claim 21, wherein said ribs are configured to direct water to said top surface of said second short rail.

* * * * *